US005199688A

United States Patent [19]

Engel

[11] Patent Number: 5,199,688

[45] Date of Patent: Apr. 6, 1993

[54] FAILURE MODES FOR A JACK

[75] Inventor: Darryl L. Engel, LaOtto, Ind.

[73] Assignee: Universal Tool & Stamping Company, Inc., Butler, Ind.

[21] Appl. No.: 944,356

[22] Filed: Sep. 14, 1992

[51] Int. Cl.[5] ..... B66F 3/12

[52] U.S. Cl. ..... 254/126

[58] Field of Search ..... 254/122, 126, 1, DIG. 3, 254/8 B; 29/267

[56] References Cited

U.S. PATENT DOCUMENTS

| | | | |
|---|---|---|---|
| 1,612,447 | 12/1926 | Larson et al. | |
| 4,088,303 | 5/1978 | Aquila | |
| 4,277,048 | 7/1981 | Okuda | 254/8 B |
| 5,064,171 | 11/1991 | Engel | 254/126 |
| 5,110,091 | 5/1992 | Engel et al. | 254/126 |
| 5,135,201 | 8/1992 | Engel et al. | 254/126 |

*Primary Examiner*—Robert C. Watson
*Attorney, Agent, or Firm*—Hill, Steadman & Simpson

[57] ABSTRACT

Scissors jacks which are provided with channels which bend during overload conditions so as to indicate to the user that the jack has been overloaded. One embodiment an accordion structure is used and in the other two embodiments metal straps are used.

10 Claims, 3 Drawing Sheets

FAILURE MODES FOR A JACK

BACKGROUND OF THE INVENTION

1. Field of the Invention

This invention relates in general to scissors jack and in particular to scissors jacks which, after failure due to overload, remain safe.

2. Description of Related Art

In an automotive industry, lightweight scissors jacks are highly desirable for C.A.F.E. requirements. To achieve this weight reduction, aluminum, composite materials, and other high strength-pound materials are being used so as to reduce the weight of the jack system. Such lightweight jacks can add danger when subjected to overload or misuse in that if failure occurs they break instantly and release the load without visual warning or time delay.

SUMMARY OF THE INVENTION

It is an object of the present invention to provide a novel scissors jack which when overloaded fails in a manner such that the jack will still hold the load, but at a somewhat reduced height. This provides the user warning that the jack is being used improperly and is overloaded with time to react. It is an object of the present invention to provide a scissors jack which when overloaded will lower the load being supported a small amount, but which will not instantly fail and drop the load so as to injure the user without warning.

It is an object of the present invention to provide a scissors jack which is formed with upper channels which include an accordion-shaped section which is weaker than the rest of the channel such that during overload condition, the channel will bend to somewhat lower the load after which the collapsed accordion portions will support the load, thus indicating to the user that the jack has been subjected to overload condition.

It is another object of the present invention to provide a scissors jack wherein the upper channels have weakened portions in which a strap of steel has been inserted which during overload collapses acting like a fuse, but which continues to support the load.

It is another object of the invention to provide a scissors-type jack wherein the upper channels are formed with a pivot to allow a first portion of the channel to bend relative to the second portion and wherein a steel strap is inserted so that under normal conditions, the channel remains straight and under overload conditions, the strap is subjected to compression and bends until it supports the channel in a bent condition, thus preventing the load from being dropped.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DETAILED DESCRIPTION OF THE PREFERRED EMBODIMENTS

Figure 1:
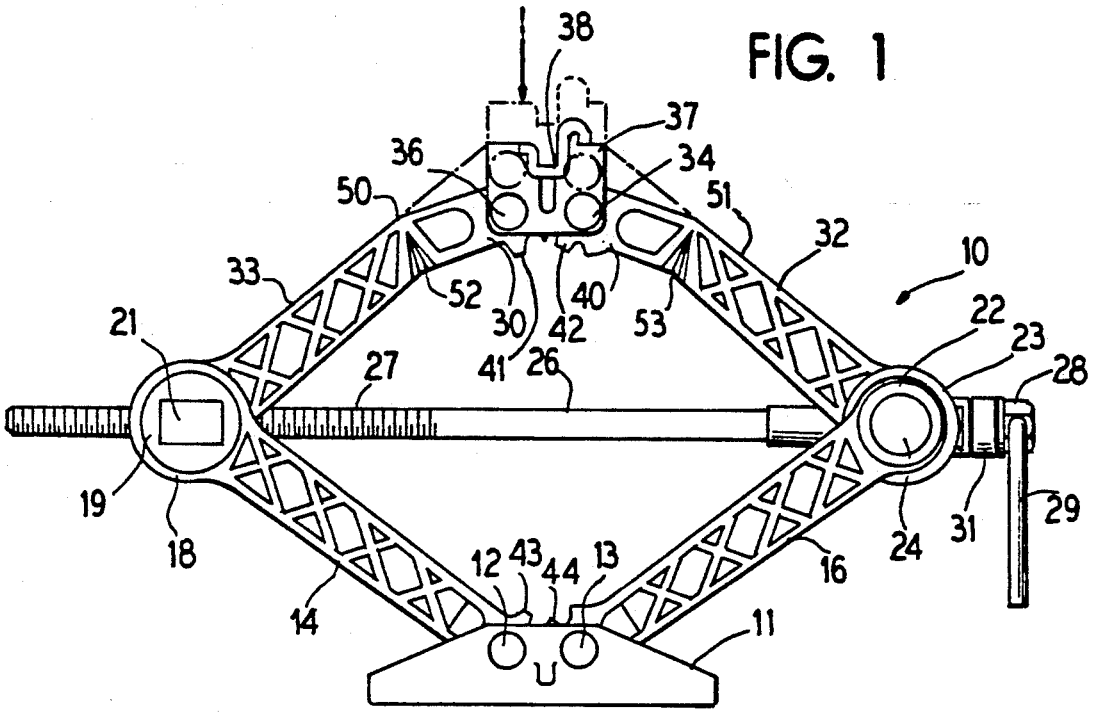
FIG. 1 is a side plan view of a scissors jack after overload.
Figure 3:
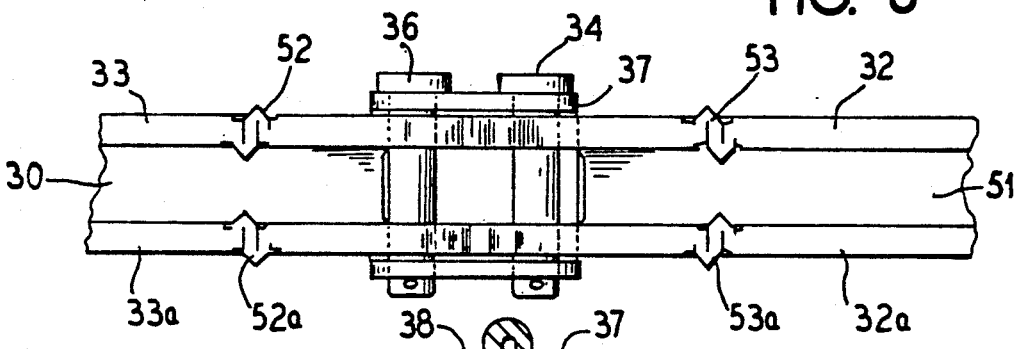
FIG. 3 is a bottom partial plan view of the jack of FIG. 1 after overload.
Figure 2:
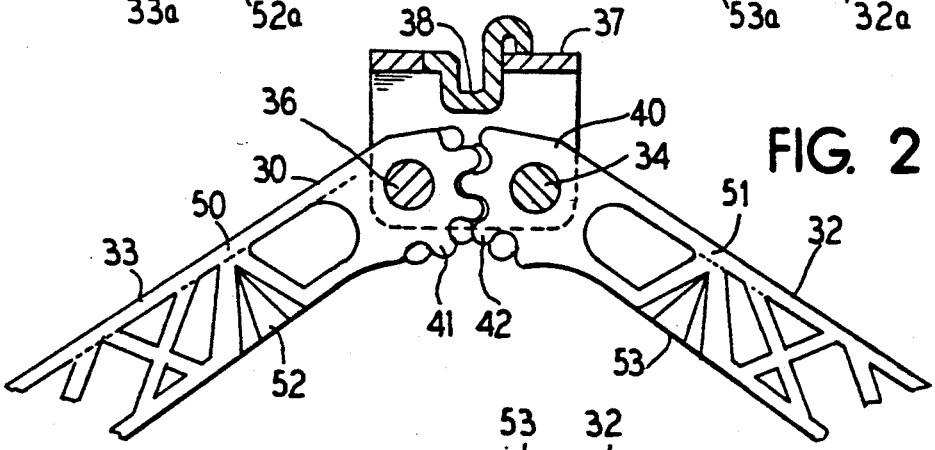
FIG. 2 is a partial side plan view in section of the upper channels of the jack of FIG. 1 before overload.
Figure 4:
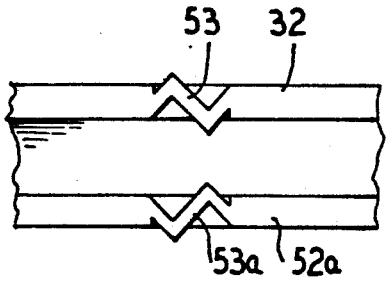
FIG. 4 is a partial bottom view of channel of the jack of FIG. 1 before overload.
Figure 5:
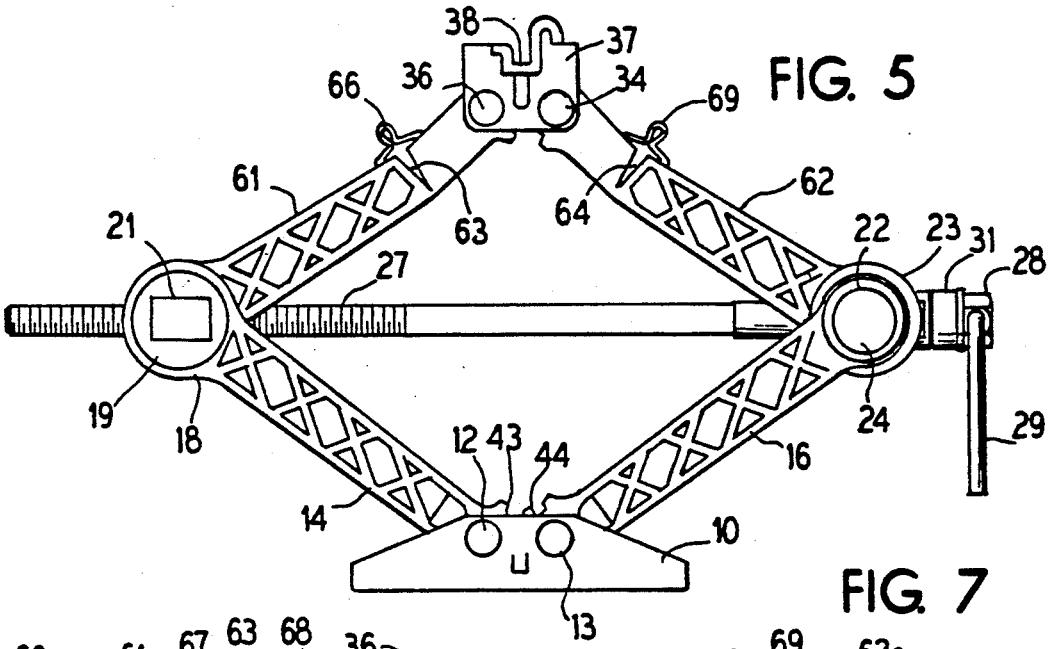
FIG. 5 is a side plan view of a second embodiment of the invention after overload.
Figure 7:
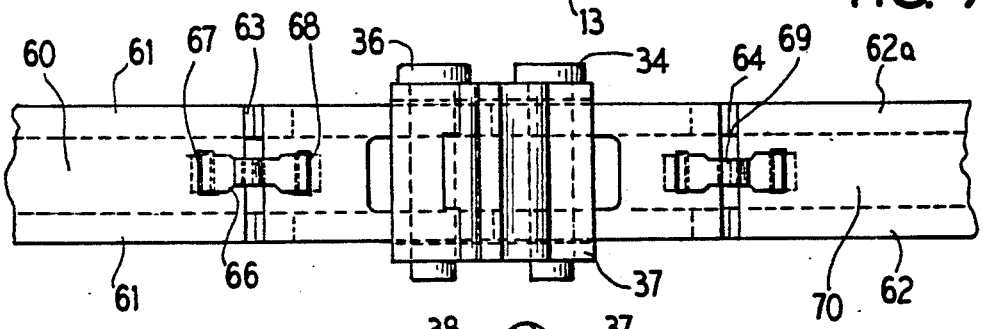
FIG. 7 is a top plan view of the upper channels of the jack of FIG. 5 after overload.

FIG. 1 illustrates a scissors jack 10 after overload of the upper beams according to the invention and comprises a base member 11 which pivotally supports lower channel members 14 and 16 by pivot pins 12 and 13. Members 14 and 16 have lower ends with gear teeth 43 and 44 which mesh together. The upper end 18 of arm 14 is rotatably connected to the lower end 19 of upper channel 33 and a threaded bracket 21 is connected at the pivot point through which the threaded portion 27 of a shaft 26 extends. The upper end 22 of channel 16 are pivotally connected to the lower end 23 of upper channel 32 by pivot pin 24 through which shaft 26 rotatably extends and a coupling 31 is attached to the shaft 26 and has a hub 28 to which a handle 29 is attached. The upper ends 30 of the upper channels 33 and the upper ends 40 of the channels 32 are provided with teeth 41 and 42 which mesh together as shown in FIGS. 1 and 2 and a pivot pin 34 connects the upper end of upper end 40 of channel 32 to a supporting bracket 37 that is formed with a notch 38 for receiving the automobile frame therein. A pivot pin 36 pivotally connects the upper end 30 of channel 33 to the bracket 37 as shown. The upper beams 32 and 33 are formed with accordion sections 52 and 53, respectively, as shown in FIGS. 1, 2, 3 and 4 such that under overload conditions the upper portions 30 and 40 will bend downwardly from the position shown in FIG. 2 and the dash-dot position in FIG. 1 to the solid line position shown in FIG. 1. Under these conditions, the accordion portions 52 and 53 will collapse on themselves so that the pleats of the accordion engage, as shown in FIG. 3, thus preventing further bending of the top portions 30 and 40 relative to the main portions of the channels 33 and 32. Thus, when the jack is being used and a load is being lifted, the user can observe that the upper channels 32 and 33 are bending to the position shown in FIG. 1 and he will observe that the load on the jack has been lowered from the dash-dot position shown in FIG. 1 to the solid line position in FIG. 1. This provides a warning to the user that overload has occurred and the user would then lower the jack and replace it with a jack of higher load capacity. It is be realized that there are two upper channels 33 and 33*a* each of which have accordion portions 52 and 52*a* and the channels are joined by a plate 30 as shown in FIGS. 2 and 3. Also, a plate 51 joins channels 32 and 32*a* as shown.

Figure 6:
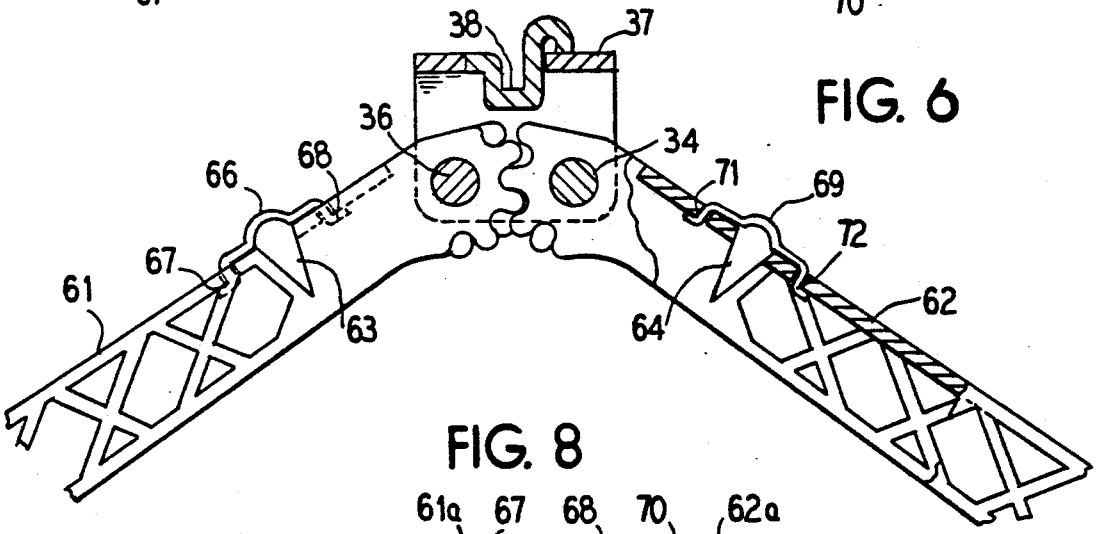
FIG. 6 is a sectional view of the upper channels of the jack of FIG. 5 before overload.
Figure 8:
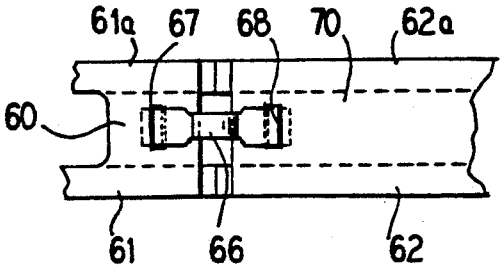
FIG. 8 is a top plan view of the channels of FIG. 5 before overload.
Figure 9:
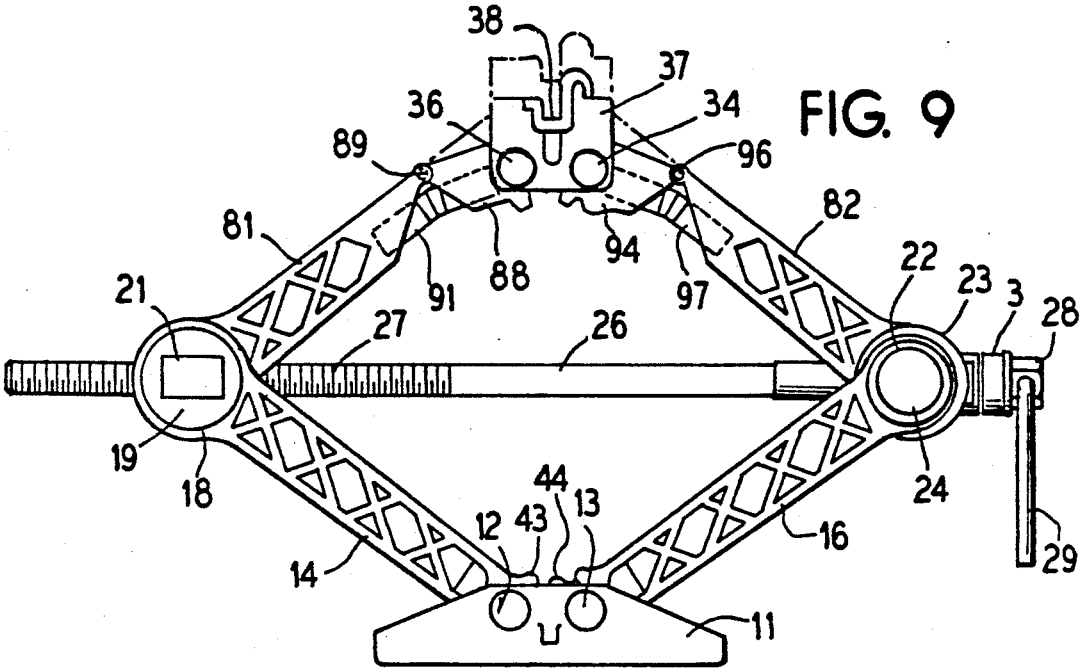
FIG. 9 is a side plan view of a third embodiment of the invention after overload.

FIGS. 5–8 illustrate a modification of the invention. In this embodiment, the base 10 and the lower channels 14 and 16 have the same structure as the jack illustrated in FIGS. 1–4 and the upper channels 61 and 62 are modified so as to have weakened V-shaped portions 63 and 64 as illustrated in FIG. 6 across which straps 66 and 69 extend with their ends 67 and 68 and 71 and 72, respectively, attached to the upper edges of the channels 61 and 62 on opposite sides of the weakened portions 63 and 64. The ends 67 and 68 and 71 and 72 are locked to the upper edges of the channels 61 and 62 as shown in FIG. 6, for example. In use, when the jack is raised, before overloaded channels 61 and 62 will have the shape illustrated in FIG. 6, but when overload occurs the V-shaped portions 63 and 64 will collapse bending the straps 66 and 69 to the shape shown in FIGS. 5 and 7.

Figure 11:
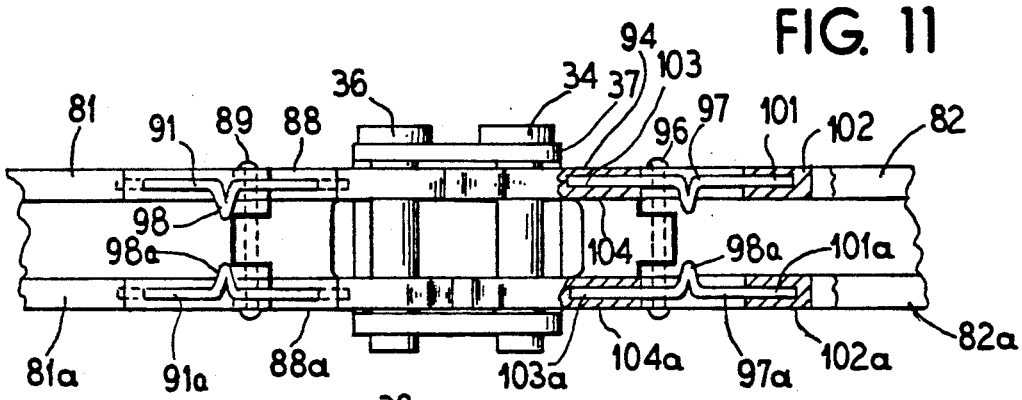
FIG. 11 is a bottom plan view of the upper channels of the jack of FIG. 9.
Figure 10:
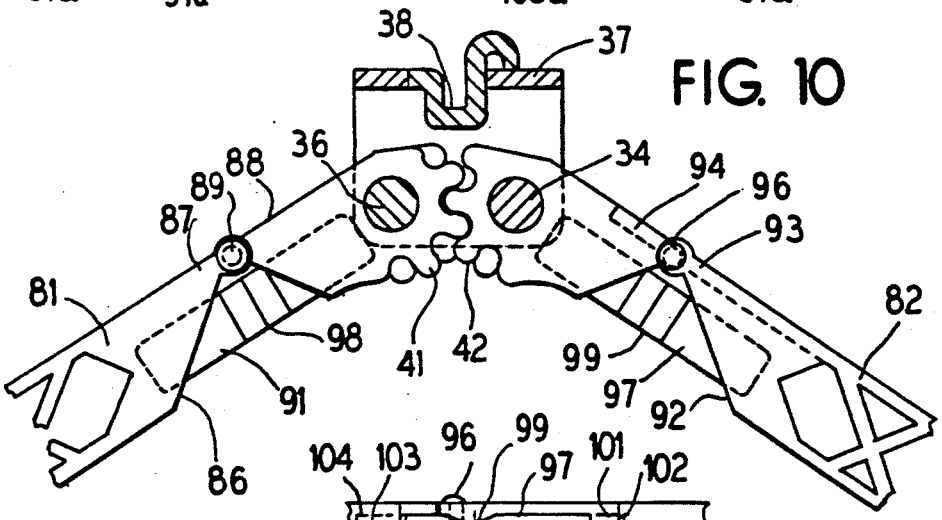
FIG. 10 is a side plan view of the upper channels of the jack of FIG. 9 before overload.
Figure 12:
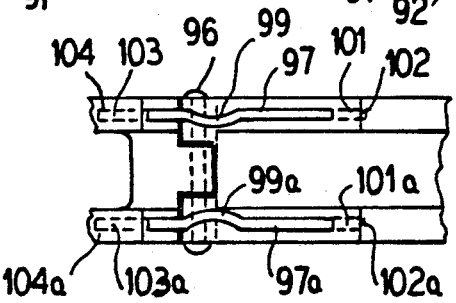
FIG. 12 is a partially cut-away view of the upper channels before overload.

A third embodiment of the invention is illustrated in FIGS. 9–12 wherein the lower channels 14 and 16 and base 11 have the same configuration as the first embodiment illustrated in FIGS. 1–4 and wherein the upper channels 81 and 82, respectively have upper portions 88 and 94 which are pivotally connected by pivot pins 89 and 96 to the main portions of the channels 81 and 82. Straps 91 and 97 are mounted in slots in the channels 81 and 82 and upper portions 88 and 94 at the lower edges beneath the pivot points 89 and 96. Strap 97 has ends 101 and 103 which are received in portions 102 and 104. Strap 97*a* is likewise mounted in portions 102*a* and 104*a* as shown. Straps 91 and 91*a* are in similar fashion. Under overload conditions, the upper portions 88 and 94 of the channels 81 and 82 bend thus causing the straps 91 and 97 to bend to the positions illustrated in FIGS. 9 and 11. It is noted that the straps 91 and 97 are formed with curved portions 98 and 99 as illustrated in FIGS. 11 and 12. Thus, in overload condition, the upper portions 88 and 94 will bend to the positions shown in FIG. 9 relative to the channels 81 and 82, thus lowering the bracket 37 from the dash-dot position in FIG. 9 to the solid line position in FIG. 9. When this occurs, the user knows that the jack has been overloaded and will lower the jack to prevent injury.

It is seen that this invention provides scissors jack which indicate when they have been overloaded so as to prevent danger to the user. Although in the illustrated examples the overload indicating and protection devices are mounted in the upper channels, they could also be mounted in the lower channels. Although the invention has been described with respect to preferred embodiments, it is not to be so limited as changes and modifications can be made which are within the full intended scope of the invention as defined by the appended claims.

I claim as our invention:

1. A scissors jack having a base member, a support bracket, lower pivoted channel members with their lower ends pivotally connected to said base member, upper pivoted channel members with their upper ends pivotally connected to said support bracket, the upper ends of said lower channel members pivotally connected to the lower ends of said upper channel members and a lead screw coupled to said lower and upper channel members for raising and lowering the jack, comprising an overload indicating and protecting means comprising, weakened portions formed in said upper channel members which upon overload of the jack allow the upper channel members to bend a limited amount without fracturing so as to indicate the overload condition.

2. A scissors jack according to claim 1 wherein said weakened portions comprise accordion-shaped sections which upon overload of the jack allow said upper channels to bend a limited amount without breaking until the accordion-shaped sections form a rigid supporting structure.

3. A scissors jack according to claim 2 wherein said accordion-shaped portions are triangular in shape and said upper channels bend about the apex of the triangles.

4. A scissors jack according to claim 1 wherein said weakened portions comprise cuts which partially extend across said upper channels which upon overload allow said upper channels to bend without breaking.

5. A scissors jack according to claim 4 wherein said cuts are V-shaped.

6. A scissors jack according to claim 5, wherein the apexes of said V-shaped cuts extend downwardly.

7. A scissors jack according to claim 5 wherein the apexes of said V-shaped cuts extend downwardly.

8. A scissors jack according to claim 5 including straps which extend across said cuts and attached to said channels on either side thereof to limit the amount of bending of said channels.

9. A scissors jack according to claim 6 including pivots formed in said channels at the apexes of said V-shaped cut 5.

10. A scissors jack according to claim 9 including straps which are attached to said channels so as to extend across said V-shaped cuts for limiting the bending of said channels about said pivots.

* * * * *